US011229823B1

(12) United States Patent
KashKash et al.

(10) Patent No.: US 11,229,823 B1
(45) Date of Patent: Jan. 25, 2022

(54) MAXIMUM PUSH-UP EXERCISE MACHINE

(71) Applicants: Omar Ismail KashKash, Palm Harbor, FL (US); Yousef Ismail KashKash, Palm Harbor, FL (US)

(72) Inventors: Omar Ismail KashKash, Palm Harbor, FL (US); Yousef Ismail KashKash, Palm Harbor, FL (US)

(73) Assignee: OK Engineering Inc., Palm Harbor, FL (US)

( * ) Notice: Subject to any disclaimer, the term of this patent is extended or adjusted under 35 U.S.C. 154(b) by 0 days.

(21) Appl. No.: 16/949,576

(22) Filed: Nov. 4, 2020

Related U.S. Application Data

(63) Continuation-in-part of application No. 16/005,194, filed on Jun. 11, 2018, now Pat. No. 10,946,241.

(51) Int. Cl.

| | |
|---|---|
| ***A63B 23/12*** | (2006.01) |
| ***A63B 21/062*** | (2006.01) |
| ***A63B 23/035*** | (2006.01) |
| ***A63B 21/00*** | (2006.01) |

(52) U.S. Cl.
CPC ..... *A63B 23/1236* (2013.01); *A63B 21/0628* (2015.10); *A63B 21/154* (2013.01); *A63B 21/4007* (2015.10); *A63B 21/4035* (2015.10); *A63B 23/03541* (2013.01)

(58) Field of Classification Search
CPC ..... A63B 23/1236; A63B 21/0628; A63B 21/154; A63B 21/4007; A63B 21/4035; A63B 23/03541; A63B 21/065; A63B 26/003; A63B 21/00058; A63B 1/00
See application file for complete search history.

(56) References Cited

U.S. PATENT DOCUMENTS

| | | | | | |
|---|---|---|---|---|---|
| 439,297 | A * | 10/1890 | Heyder | F41B 3/00 | 124/5 |
| 1,837,872 | A * | 12/1931 | Johnson | A61F 5/04 | 602/34 |
| 4,111,414 | A * | 9/1978 | Roberts | A63B 1/00 | 482/102 |
| 4,186,921 | A * | 2/1980 | Fox | A63B 69/0088 | 24/115 H |
| 4,431,184 | A * | 2/1984 | Lew | A63B 7/00 | 482/102 |
| 4,606,539 | A * | 8/1986 | Farnham | A63B 21/0023 | 482/148 |
| 5,033,741 | A | 7/1991 | Ganzer | | |
| 5,042,796 | A * | 8/1991 | Jibril | A63B 23/12 | 482/105 |

(Continued)

*Primary Examiner* — Garrett K Atkinson
(74) *Attorney, Agent, or Firm* — Nicholas Pfeifer; Smith & Hopen, P. A.

(57) ABSTRACT

A maximum push-up exercise machine for various push-up exercises in the prone position on a platform with added resistance. An embodiment of the device includes a cable-pulley weight stack system housing with a cable-pulley weight stack system that is welded, bolted, or connected in any manner to the platform. The configuration of the cable-pulley weight stack system may be in any manner such that a cable thimble is positioned midpoint of the platform. The cable thimble is configured to connect to receive a snap link hook suspended from a harness or belt worn by a user, connect to a single cable handle attachment, and connect to a push-up bar via a push-up bar cable connector.

20 Claims, 15 Drawing Sheets

(56) References Cited

U.S. PATENT DOCUMENTS 5,072,947 A * 12/1991 Blue ..... A63B 67/002 273/371
5,165,682 A * 11/1992 McGuckin ..... A63B 43/04 473/424
5,352,176 A * 10/1994 Huang ..... A63B 21/0004 482/123
5,421,800 A * 6/1995 Mullen ..... A63B 21/00181 482/121
5,615,879 A * 4/1997 Bailey ..... A63B 69/0088 473/424
5,713,799 A * 2/1998 Balmat ..... A63B 43/008 40/327
6,155,957 A * 12/2000 Worley ..... A63B 5/16 482/15
6,220,994 B1 * 4/2001 Rich ..... A63B 21/0004 482/123
6,244,998 B1 6/2001 Hinds
6,419,586 B1 * 7/2002 Chiu ..... A63B 22/18 472/135
6,461,285 B1 * 10/2002 Theunissen ..... A63B 26/003 273/110
6,554,747 B1 * 4/2003 Rempe ..... A63B 21/04 482/38
6,719,676 B1 * 4/2004 Hsu ..... A63B 21/0004 446/220
6,945,919 B2 * 9/2005 Yang ..... A63B 5/11 482/141
7,566,291 B2 * 7/2009 Lickle ..... A63B 26/003 482/51
7,588,521 B1 * 9/2009 Fazzari ..... A63B 21/06 482/141
7,614,987 B2 * 11/2009 Guadagno ..... A63B 21/0004 273/449
7,645,221 B1 * 1/2010 Curry ..... A63B 23/12 482/148
7,857,740 B2 * 12/2010 Suaste ..... A63B 22/16 482/142
7,981,010 B1 * 7/2011 Webber ..... A63B 23/1209 482/96
8,057,367 B2 * 11/2011 Giannelli ..... A63B 21/0628 482/102
8,162,807 B1 * 4/2012 Webber ..... A63B 21/0615 482/100
8,277,327 B2 * 10/2012 Takeda ..... A63F 13/02 463/47
8,715,144 B1 * 5/2014 Friess ..... A63B 21/4033 482/123
8,771,155 B1 * 7/2014 Bell ..... A63B 21/4017 482/124
8,882,645 B2 * 11/2014 Baptiste ..... A63B 21/0552 482/121
8,936,539 B2 * 1/2015 Richard ..... A63B 22/16 482/123
8,944,971 B2 * 2/2015 Shorter ..... A63B 21/072 482/108
8,992,399 B2 * 3/2015 Wehrell ..... A61H 1/0229 482/124
9,132,330 B2 * 9/2015 Brendle ..... A63B 21/169
9,144,702 B2 * 9/2015 Calderone ..... A63B 23/1209
9,155,934 B2 10/2015 Kassel
9,180,338 B2 * 11/2015 Sorace ..... A63B 21/4005
9,205,299 B1 * 12/2015 Hall ..... A63B 21/0557
9,272,179 B2 * 3/2016 Lemos ..... A63B 23/12
9,295,872 B2 * 3/2016 Martens ..... A63B 21/0724
9,302,139 B2 * 4/2016 Habing ..... A63B 21/4035
9,327,157 B1 * 5/2016 Miller ..... A63B 21/4043
9,446,285 B1 * 9/2016 Drath ..... A63B 23/03558
9,486,668 B2 * 11/2016 Williams ..... A63B 21/00065
9,511,258 B2 * 12/2016 Hoole ..... A63B 21/0615
9,616,274 B2 * 4/2017 Wehrell ..... A63B 21/4009
9,849,327 B2 * 12/2017 Nikkaran ..... A63B 23/03541
9,950,211 B2 * 4/2018 Williams ..... A63B 21/063
10,188,890 B2 * 1/2019 Olson ..... A63B 21/4035
10,220,236 B2 * 3/2019 Oltorik, Jr. ..... A63B 21/4043
10,226,665 B2 * 3/2019 Kordecki ..... A63B 23/0216
10,286,279 B2 * 5/2019 Wehrell ..... A63B 21/16
10,426,989 B2 * 10/2019 Dalebout ..... A63B 22/02
2003/0158021 A1 * 8/2003 Prichard ..... A63B 69/0057 482/123
2004/0242388 A1 12/2004 Kusminsky
2005/0009677 A1 * 1/2005 Yang ..... A63B 21/0004 482/142
2006/0040808 A1 * 2/2006 Riazi ..... A63B 71/023 482/141
2006/0199706 A1 * 9/2006 Wehrell ..... A63B 21/4019 482/92
2007/0129226 A1 * 6/2007 Leavitt ..... A63B 23/0458 482/129
2010/0130338 A1 * 5/2010 Wehrell ..... A63B 21/154 482/124
2011/0275499 A1 * 11/2011 Eschenbach ..... A63B 21/00181 482/141
2013/0123081 A1 * 5/2013 Boland ..... A63B 21/023 482/141
2014/0274593 A1 9/2014 Kelly

* cited by examiner

MAXIMUM PUSH-UP EXERCISE MACHINE

CROSS-REFERENCE TO RELATED APPLICATIONS

This nonprovisional application is a continuation of and claims priority to nonprovisional application Ser. No. 16/005,194, entitled "MAXIMUM PUSH-UP EXERCISE MACHINE," filed Jun. 11, 2018 by the same inventors.

BACKGROUND OF THE INVENTION

1. Field of the Invention

This invention relates, generally, to exercise equipment. More specifically, it relates to an exercise machine that allows a user to safely perform push-ups with added resistance.

2. Brief Description of the Prior Art

Push-ups have always been used to measure one's body strength and is beneficial to people of all ages. Many people do bodyweight exercises such as push-ups along with weightlifting exercises in their workouts. However, people have the need to add resistance to push-ups in a safe and convenient manner to match the intensity of their weightlifting exercises within the timeframe of their workouts. People do push-ups with added resistance for two reasons: 1) keep doing pushups with added intensity, and 2) improve bench press performance.

There are many pre-existing methods for adding resistance to pushups, however, the pre-existing methods have significant drawbacks including major safety concerns. For examples, the most common approach in commercial gyms includes placing weight plates on the exerciser's back or wearing a weight vest. The exerciser typically engages the help of a partner to put the weight plate on their back and take the weight off when the set of push-ups is complete.

In U.S. Pat. No. 7,588,521 to Carlo Fazzari (2009) one does push-ups with weights placed on weight support platform placed on one's back and as pushups are repeated the weight support platform with parallel upright rods slide up and down along parallel guide elements.

In U.S. Pat. No. 9,511,258 to Richard J. Hoole (2016) a user performs weighted push-ups by grasping on a pair of hand grips that are above a lever arm and feet are placed on an elevated platform that is adjustable in height relative to the pair of hand grips. The lever arm has a proximate end coupled pivotally to a base and the lever arm is configured to provide a resistance against vertical movement of a distal end of the lever arm. The distal end of the lever arm is configured to receive a connector suspended from a belt or harness worn by a user.

In U.S. Pat. No. 5,033,741 to Ganzer (1991) a wall mounted isometric push-up machine allows a user to perform push-ups against a padded base that provides resistance in the vertical direction using pressure springs. The user can adjust the amount of resistance by changing the pressure spring.

Few people in commercial gyms use chains to add resistance to push-ups by laying it over their back forming an X-shape. Another way people add resistance to push-ups is by using resistance bands. Some use clip bands/flat bands/strength bands to loop it over their backs and place their hands on the band and do push-ups. For example, in U.S. Pat. No. 6,244,998 to Jon Harrington Hinds (2001) push-ups with added resistance are performed by placing a padded cushion on one's back and resistance bands are attached to it and to soft handles at the other end. In U.S. Pat. No. 9,205,299 to Raashed Hall (2015) a kind of resistance band known as flat band is looped around one's back and attached to hand grips to add resistance to push-ups. In U.S. Pat. No. 9,155,934 to Blake Kassel (2015) a user performs push-ups with added resistance using a resistance band known as clip band that loops around one's back and attached to hand grips.

In U.S. Patent Application Publication 20040242388 to Richard Kusminsky (2004) a user performs push-ups with added resistance by using a unidirectional exercise machine for increasing the effort required for a user to perform a push-up or other exercise including an adjustable brake engaging a cable drum for inhibiting the unwinding of a cable attached to a user during the extending portion of the exercise and a clutch operatively coupled to the brake for releasing the brake and allowing the cable to freely rewind during the retracting portion of the exercise.

In U.S. Patent Application Publication 20140274593 to Sean Kelly (2014) a user performs push-ups with added resistance by using a resistance push-up apparatus having a harness to be worn by a user and having hooks to attach the harness to a set of free weights. The push-up apparatus allowing the user to lift his or her own weight plus the extra free weights connected to the harness during the push-up exercise.

However, it is not safe to put a lot of weight plates on your back and do pushups even in the presence of a partner. In the case of wearing a weight vest, it is not safe to wear a heavy weight vest when doing pushups and reaching near failure. It is difficult to get out of a set of pushups when using a weight vest. The use of chains is not practiced at most commercial gyms and is inconvenient. For Fazzari's disclosure, it is difficult to get out of the prone (starting) position when done performing finger push-ups as the weight is still on the user or the weight support platform is right above the user. For Hoole's disclosure, one cannot perform push-ups such as finger push-ups and knuckle (punch/fist) push-ups with added resistance. For Hind's disclosure, one cannot perform finger push-ups and knuckle push-ups as well as push-ups with different hand grips with added resistance. It causes pain in the hands and wrists when using heavy resistance bands because the soft handles loop around the thumbs. For Hall's disclosure, one cannot perform finger push-ups and knuckle push-ups as well as push-ups with different hand spacing with added resistance. Also, one is limited by the amount of resistance they can use since only one flat band is used and other kinds of bands cannot be used. For Kassel's disclosure, one cannot perform finger push-ups, knuckle (punch/fist) push-ups, and push-ups with different hand spacing with added resistance. The resistance band may move or slide when one reaches the starting position of a push-up. For Kusminsky's disclosure, one cannot perform finger push-ups and knuckle push-ups as well as push-ups with different hand grips with added resistance. For Kelly's disclosure, it requires one to setup and create space for those who train in commercial gyms. Even if commercial gym members use two benches to execute push-ups with added resistance the benches are usually occupied by other gym members doing other exercises either by the dumbbell rack or in power racks/smith machines. Those interested in doing partial push-ups (the last few inches before the end position of a push-up) and isometric push-ups (static contraction) would have to setup and cannot easily do that in commercial gyms.

These disclosures heretofore known suffer from a few disadvantages:

1. One cannot perform various push-up exercises such as finger push-ups, knuckle (punch/fist) push-ups, push-ups with different hand grips, planks, and push-up to row (A.K.A. push-up renegade row) with added resistance to failure independently in a safe and convenient manner along with other exercises in a workout without sacrificing valuable time for productive muscle building with time spent on setting up which most people do not have especially commercial gym members.
2. One cannot perform various push-up exercises such as finger push-ups, knuckle push-ups, push-ups with different hand grips, planks, and push-up to row with added resistance all in one machine.

Accordingly, what is needed is an improved exercise machine that allows an exerciser to perform a variety of push-ups with added resistance in a safe manner. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for an improved exercise machine that allows an exerciser to perform a variety of push-ups with added resistance in a safe manner is now met by a new, useful, and nonobvious invention.

An embodiment of the present invention is an exercise device for generally performing resisted push-up exercises. The device include a housing containing a plurality of resistance members and a cable in operable communication with one or more of the plurality of resistance members, such that forcible movement of the cable imparts a force onto the one or more resistance members in operable communication with the cable. A first attachment component is also in operable communication with the cable and is configured to engage a user-interactable device. The present invention further includes a horizontal platform having a top surface, a bottom surface, and a passage extending through the top surface towards the bottom surface. The passage is sized to house the attachment component in operable communication with the cable when the exercise device is not in use by a user.

The first attachment component further includes a position of repose when not subject to an external force applied by the user. The position of repose includes the first attachment component residing below the top surface of the platform and being unable to exit the cable passage without an external force overcoming a resistance force of the one or more resistance members in operable communication with the cable. As a result, the user can reach a full push-up flexion position with the user's chest on the top surface of the platform while the first attachment component remains subject to the resistance force of the one or more resistance members.

Some embodiments include at least one pulley to guide the cable from the housing to the passage in the platform. In some embodiments, an exit pulley is located adjacent to the passage in the platform below the top surface of the platform. The exit pulley is configured to guide the cable from a horizontal orientation prior to the passage in the platform to a vertical orientation at the passage. Thus, the user can pull the cable vertically while executing a push-up.

In some embodiments, the passage in the platform is located at a position in the platform in which there are no permanent structures preventing a user from performing push-ups with the user's hands on the top surface of the platform and chest in overlying relation to the passage.

In some embodiments, the resistance members are weights adapted to move within the housing when subject to an external force.

In some embodiments, the first attachment component is a cable thimble. Some embodiments further include an upper body harness having a second attachment component configured to mechanically engage the first attachment component. In some embodiments, the passage is sized to receive both the first and second attachment components. Thus, the passage can receive the first and second attachment components below the top surface of the platform when the user reaches a full push-up flexion position with the user's chest adjacent to the top surface of the platform.

Some embodiments further include a partial spherical balancing device having a generally centrally located aperture in a curved outer surface sized to receive at least a portion of the cable. Some embodiments further include a push-up bar having a second attachment component configured to mechanically engage the first attachment component.

Some embodiments further include a hinge residing between the platform and the housing containing the plurality of resistance members, thereby enabling the platform to fold upward into a vertical orientation. In addition, some embodiments include a pulley located adjacent to the rotational axis of the hinge that permits the platform to fold upward into a storage orientation without compromising the integrity of the cable.

An embodiment of the present invention includes an exercise device for performing resisted push-up exercises, comprising a housing containing a plurality of resistance members; a cable in operable communication with one or more of the plurality of resistance members, such that forcible movement of the cable imparts a force onto the one or more resistance members in operable communication with the cable; a first attachment component in operable communication with the cable; a second attachment component configured to engage the first attachment component and a user-interactable device; and a horizontal platform having a top surface, a bottom surface, and a passage extending through the top surface towards the bottom surface with the passage sized to receive both the first and second attachment components. Thus, the passage can receive the first and second attachment components below the top surface of the platform when the user reaches a full push-up flexion position with the user's chest adjacent to the top surface of the platform.

Some embodiments include a pulley located adjacent to the passage in the platform and below the top surface of the platform. The pulley is configured to guide the cable from a horizontal orientation prior to the passage in the platform to a vertical orientation at the passage, thereby allowing the user to pull the cable vertically while executing a push-up.

In some embodiments, the passage in the platform is located at a position in the platform in which there are no permanent structures preventing a user from performing push-ups with the user's hands on the top surface of the platform and chest in overlying relation to the passage.

In some embodiments, the resistance members are weights adapted to move within the housing when subject to an external force.

In some embodiments, the user-interactable device is a push-bar. In some embodiments, the user-interactable device is an upper body harness.

Some embodiments include a partial spherical balancing device having a generally centrally located through hole sized to receive the cable.

Some embodiments include a hinge residing between the platform and the housing containing the plurality of resistance members. The hinge enables the platform to fold upward into a vertical orientation for storage.

An embodiment of the present invention includes an exercise device for performing resisted push-up exercises, comprising a housing containing a weight stack, wherein in the weight stack includes a plurality of weights adapted to move within the housing when subject to an external force. The invention further includes a cable having a first end and a second end with the first end in operable communication with one or more weights in the weight stack, such that tension imparted on the cable acts as the external force to move the plurality of weights. A first attachment component is in operable communication with the second end of the cable and an upper body harness has a second attachment component configured to mechanically engage the first attachment component. The present invention further includes a horizontal platform having a top surface, a bottom surface, and a passage extending through the top surface towards the bottom surface. The passage is sized to receive both the first and second attachment components. The cable extends from the housing to the passage and passing underneath the top surface of the platform. Moreover, the passage is sized to receive the first and second attachment components below the top surface of the platform when the user reaches a full push-up flexion position with the user's chest adjacent to the top surface of the platform. Furthermore, the second end of the cable and the first and second attachment components are configured to exit the passage through the top surface of the platform when the user is wearing the harness and reaches a full push-up extension position.

Accordingly, several advantages of one or more aspects are as follows: to provide a maximum push-up exercise machine that enables a user wearing a belt or harness to perform push-ups (regular, finger, and knuckle) with added resistance and to quickly change the resistance level independently, that enables a user to perform planks and push-up to row exercises with added resistance, and that enables a user to perform push-ups on balance and stabilization ball device with added resistance. These advantages will be apparent from a consideration of the drawings and ensuing descriptions.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In the following detailed description of the preferred embodiments, reference is made to the accompanying drawings, which form a part thereof, and within which are shown by way of illustration specific embodiments by which the invention may be practiced. It is to be understood that other embodiments may be utilized, and structural changes may be made without departing from the scope of the invention.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

The phrases "in some embodiments," "according to some embodiments," "in the embodiments shown," "in other embodiments," and the like generally mean the particular feature, structure, or characteristic following the phrase is included in at least one implementation. In addition, such phrases do not necessarily refer to the same embodiments or different embodiments.

The word "exemplary" is used herein to mean "serving as an example, instance, or illustration." Any embodiment or design described herein as "exemplary" is not necessarily to be construed as preferred or advantageous over other embodiments or designs.

The term "resistance member" as used herein refer to object(s) configured to increase the difficulty in performing an exercise when a user-interactable device is in operable communication with the resistance member(s). The drawings depict resistance members in the form of weights. However, an embodiment of the present invention may employ resistance bands or spring/elastic members as resistance members.

In the exemplary figures, the user-interactable devices are in operable communication with the resistance members through a cable. The term "cable" as used herein includes any elongated member having a sufficient tensile strength to support the tension created by the user performing exercises when the user-interactable devices are in operable communication with the resistance members. Non-limiting examples include wire, rope, and chain.

The term "user-interactable device" includes exercise equipment adapted to be used with the present invention that is handled or engaged by a user.

The term "attachment component" refers to a component configured to attach or aid in the attachment of at least two objects together. Non-limiting examples include cable thimbles, hooks, clips, rings, loops, structural catches, and other fasteners known to a person of ordinary skill in the art.

Figure 1A:
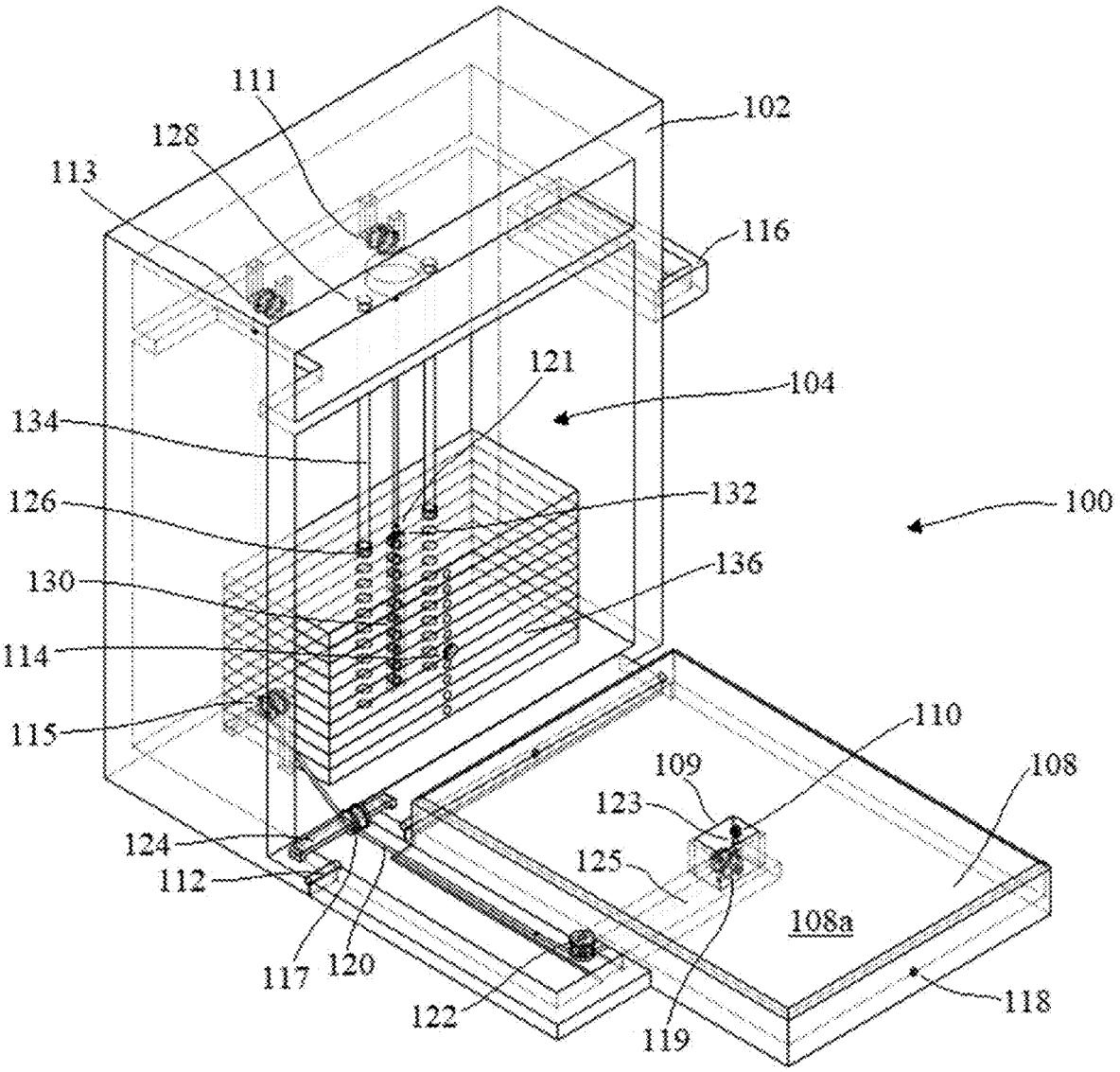
FIG. 1A is a perspective view of a maximum push-up exercise machine in accordance with one embodiment.

Referring now to FIG. 1A, an exemplary embodiment of a maximum push-up exercise machine includes housing 102, resistance members 136, and a platform 108. Housing 102 partially encloses resistance members 136 and platform 108 provides the area in which to perform the exercises.

The exemplary depicted housing 102 houses resistance members 136 in the form of a cable-pulley weight stack system 104. Cable-pulley weight stack system 104 includes a plurality of weights that can be individually selected to modify the amount of resistance. The selection is accomplished through weight stack selector pin 114, which is inserted into weight stack 136. In some embodiments, resistance members 136 are in the form of elastic resistance bands. However, resistance bands have a linear resistance profile in comparison to weights. Thus, weights may be preferable in certain situations. Alternatively, the linear resistance profile may be preferable in certain other situations.

The cable-pulley weight stack system includes cable 120 having first end 121 in mechanical communication with resistance members 136 and second end 123 integrated with or in mechanical communication with first attachment component 110. The cable-pulley weight stack system may include any belts, cables, cams, pulleys, or any combination thereof to enable the operation of the cable-pulley weight stack system.

As depicted best in FIG. 1A, first end 121 of cable 120 is in mechanical communication with cable-to-weight stack adapter 132. Cable-to-weight stack adapter 132 is used in conjunction with weight stack center selector shaft 130 and weight selector pin 114 to selectively adjust the amount of weight that the user must overcome during the exercises.

Cable 120 is routed from first end 121 through several pulleys to its second end 123. In the depicted embodiment, cable 120 extends to pulley 111, which directs cable 120 horizontally to pulley 113, which redirects cable 120 vertically. Cable 120 then extends to pulley 115, which directs cable 120 to pulley 117 that is adjacent to the rotational axis of hinge 112. Cable 120 continues to pulley 122 which directs cable 120 under top surface 108*a* of platform 108. Finally, cable 120 encounters exit pulley 119, which directs cable 120 in a generally vertical direction through passage 109 in platform 108.

Figure 1B:
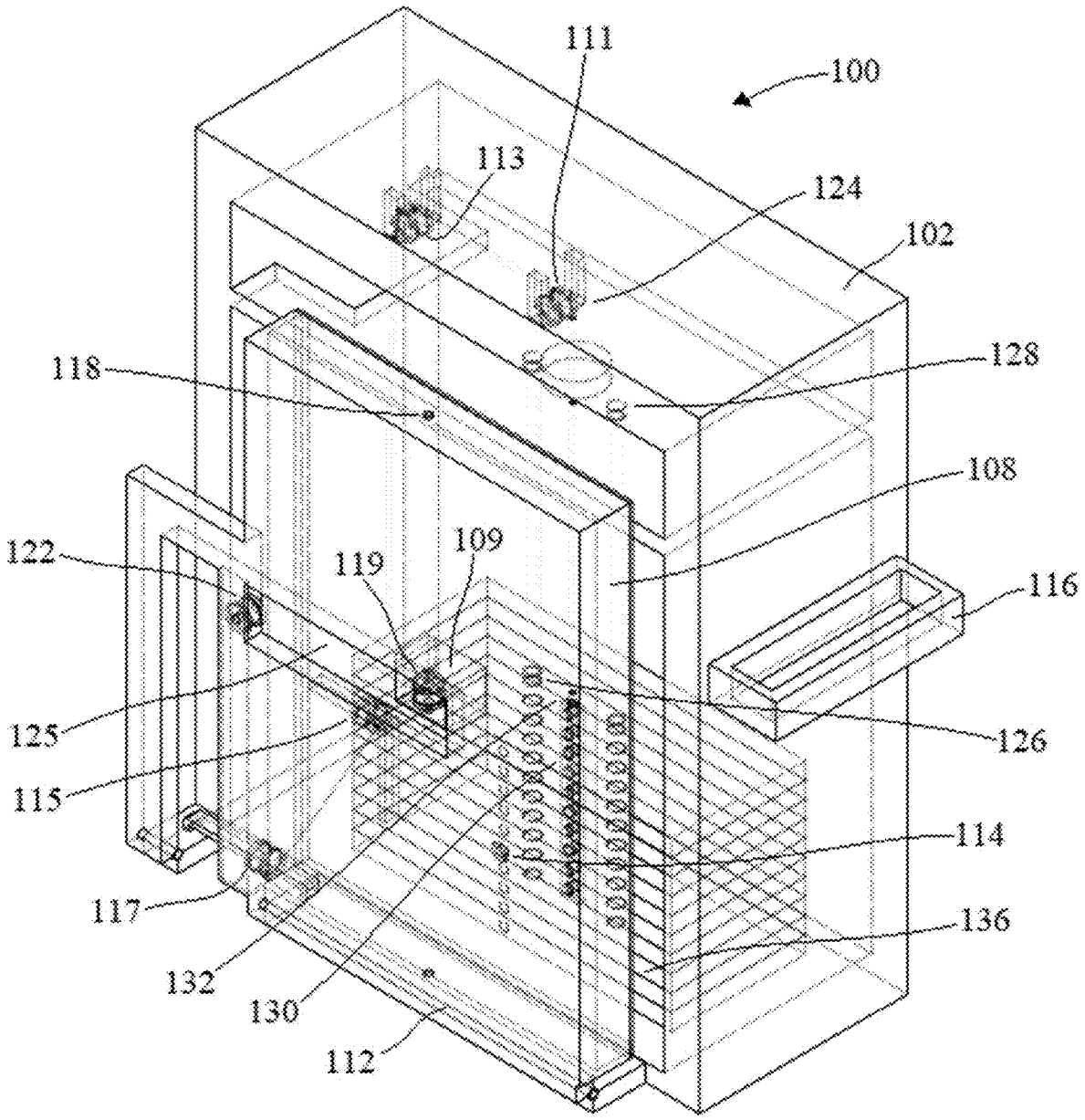
FIG. 1B is a perspective view of a maximum push-up exercise machine in accordance with one embodiment showing the machine in a folded space-saving orientation.

As shown in FIG. 1B, an embodiment of invention includes pulleys 122 and 119 secured to platform 108, thereby ensuring that said pulleys transition with platform 108 when platform 108 is rotated into the vertical storage position. The embodiment also includes a cable channel 125 extending through platform 108 to provide a passage for cable 120 through platform 108 from pulley 122 to pulley 119.

Second end 123 of cable 120 is integrated with or attachable to first attachment component 110. The figures provide an exemplary form of first attachment component 110 in the form of a cable thimble. Cable thimble 110 passes through passage 109 and can connect to a user-interactable device such as upper body harness 146 having a second attachment component such as a clip, push-up bars 138 having a second attachment component in the form of push-up bar cable connector 140, or single cable handle attachment 148 having a second attachment component. In an embodiment, first attachment component 110 is a cable thimble configured to receive second attachment component, in the form of a snap link hook suspended from harness 146 or a belt worn by user 106.

In some embodiments, second end 123 of cable 120 is configured to become subject to tension from the connection to the resistance members prior to second end 123 exiting passage 109 through upper surface 108*a* of platform 108.

Thus, a user can perform a push-up to maximum flexion (i.e., till the user's chest touches the top surface 108*a*) while subject to resistance.

In some embodiments, first attachment component 110 attached to cable 120, similar to second end 123 of cable 120, is configured to be under tension below the upper surface 108*a* of platform 108. Thus, a user can perform a push-up to maximum flexion (i.e., till the user's chest touches the top surface 108*a*) while subject to resistance.

Platform 108 can be bolted, welded, hingedly connected, or connected in any manner to housing 102 containing a plurality of resistance members. FIG. 1B shows the platform rotated about hinge 112. Thus, platform 108 can be rotated about the rotational axis of hinge 112 to bring platform 108 into a vertical orientation (i.e., a storage orientation) which reduces the footprint of the device. This may aid in saving space in the storage and transportation of maximum push-up exercise machine from one place to another.

As explained previously, platform 108 includes a passage 109 extending through top surface 108*a* to at least cable channel 125. Some embodiments include passage 109 extending completely though platform 108.

In some embodiments, passage 109 is sized to receive first attachment component 110 and a second attachment component, such as a clip, secured to harness 146. As a result, the user can perform a push-up to maximum flexion (i.e., till the user's chest touches the top surface 108*a*) without the attachment components preventing the user from touching his/her chest to top surface 108*a* of platform 108.

In some embodiments, passage 109 is centrally located at substantially the midpoint of platform 108. In addition, the configuration of the pulleys ensures that cable thimble 110 is positioned to exit passage 109 in platform 108 in a generally vertical direction.

In some embodiments, passage 109 is positioned at a location in platform 108 to ensure that there are no permanent structural components that would impede a user's ability to perform various push-up exercises. In some embodiments, passage 109 is located at a position in platform 108 in which there are no permanent structures preventing a user from performing push-ups with the user's hands on top surface 108*a* of platform 108 and chest in overlying relation to passage 109.

Some embodiments include chain 150 having snap link hook suspended from the harness or belt 146 that the user can adjust the length of chain 150 to any link and connect the snap link hook to cable thimble 110.

Some embodiments include housing 102 having container 116 to hold items such as towels, cleaning agent spray bottle, water bottle, etc.

The material of the cable-pulley weight stack system housing may be made of stainless steel or any other material known in the art. The material of the platform may be made of stainless steel covered with rubber like material such as rubber molded handle grips used in exercise handles, particle board/plywood covered with rubber horse stall mats like a weight lifting platform, any combination thereof, or any material known in the art.

Some embodiments further include partial spherical balancing device 142 having a generally centrally located aperture 144 in a curved outer surface sized to receive at least a portion of cable 120. In some embodiments, aperture 144 is a through hole sized to receive cable 120, first attachment component 110, and/or chain 150. Partial spherical balancing device 142 allows a user to engage in resisted push-ups on an unstable platform. In some embodiments, the balancing device is a fully spherical shape with a through hole passing through the device.

Some embodiments further include push-up bars 138 having second attachment component 140 configured to mechanically engage the first attachment component. Thus, one of the push-up bars 138 can be attached to cable 120 via second attachment component 140 and user 106 can perform a push-up into a resisted row.

Operation (FIGS. 2, 3, 4, 5, 6, 7, and 8)

A user performs a push-up exercise with added resistance by first selecting a desired weight by inserting weight stack selector pin 114 into weight stack 136. Then, user 106 wears a harness or belt adjusting the length of the chain to any link and leans forward on platform 108 and attaches snap link hook suspended from a belt or harness to cable thimble 110. In some embodiments, user 106 wears a harness or belt 146 with chain 150 having snap link hook suspended from harness or belt 146 that the user can adjust the length of the chain to any link and connect the snap link hook to cable thimble 110.

Figure 2A:
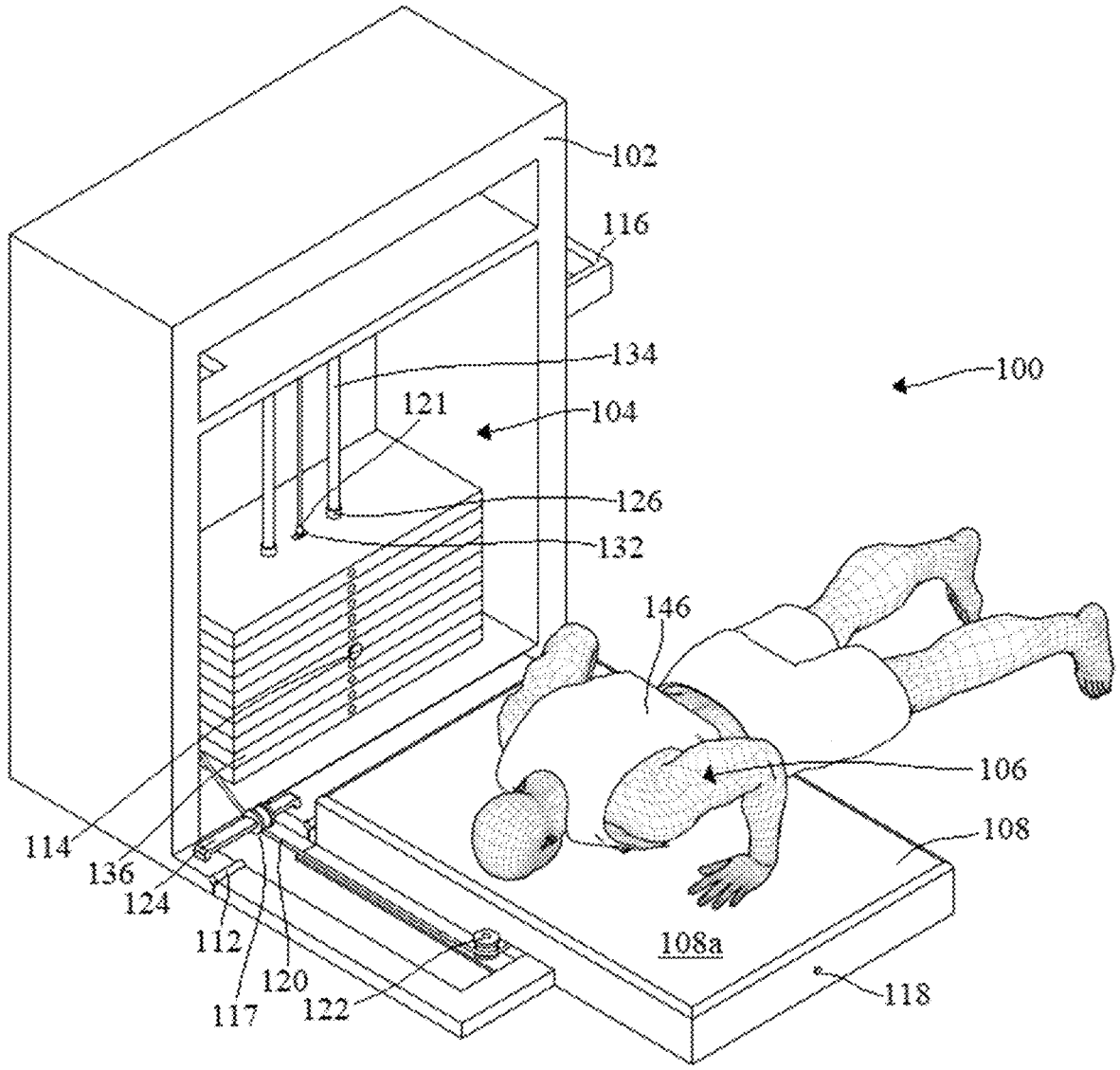
FIG. 2A is a perspective view of an embodiment of the maximum push-up exercise machine showing a user in a lowermost position while performing a push-up exercise on the device.
Figure 2B:
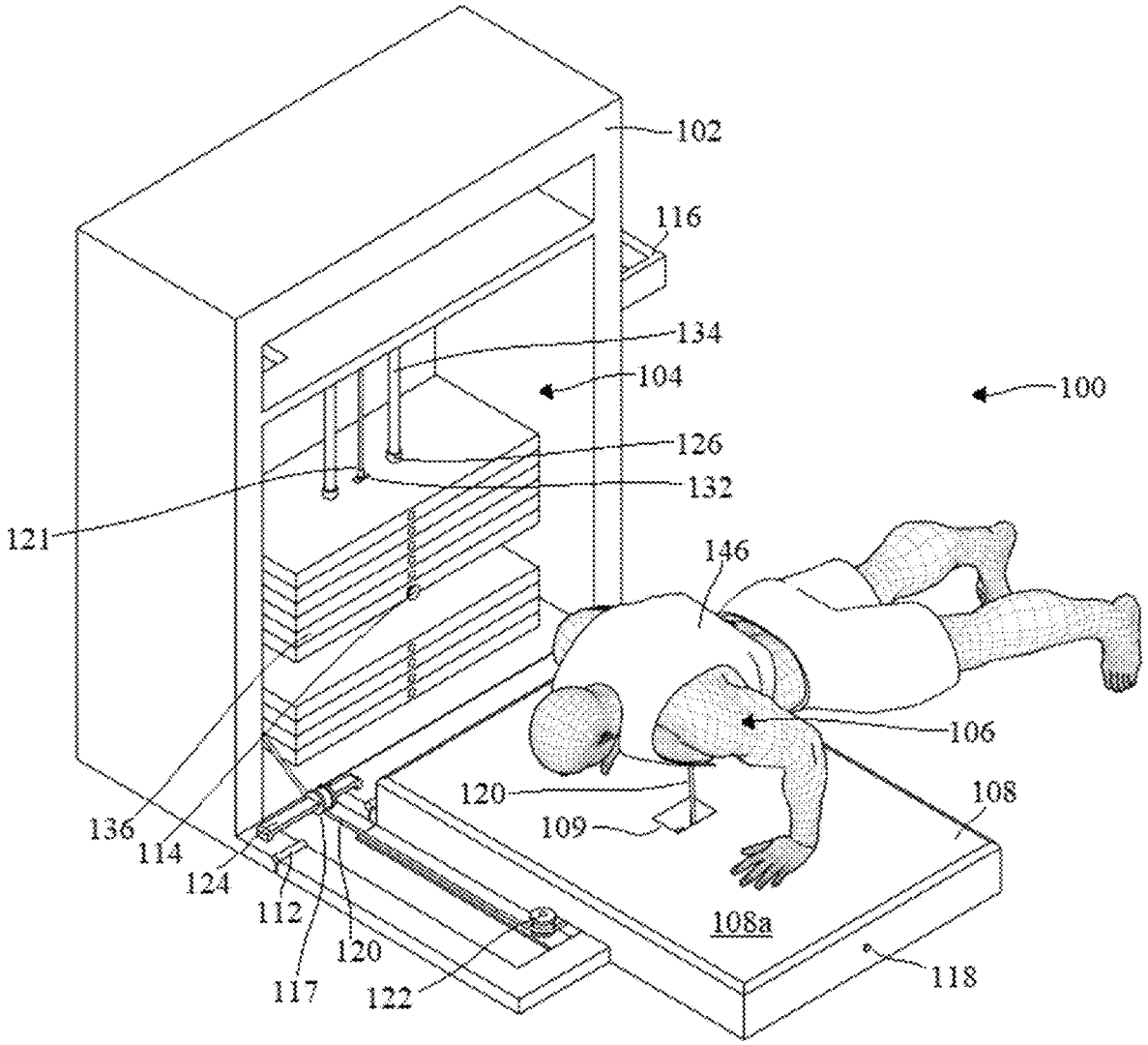
FIG. 2B is a perspective view of an embodiment of the maximum push-up exercise machine showing a user in a partial extension position while performing a push-up exercise on the device.
Figure 2C:
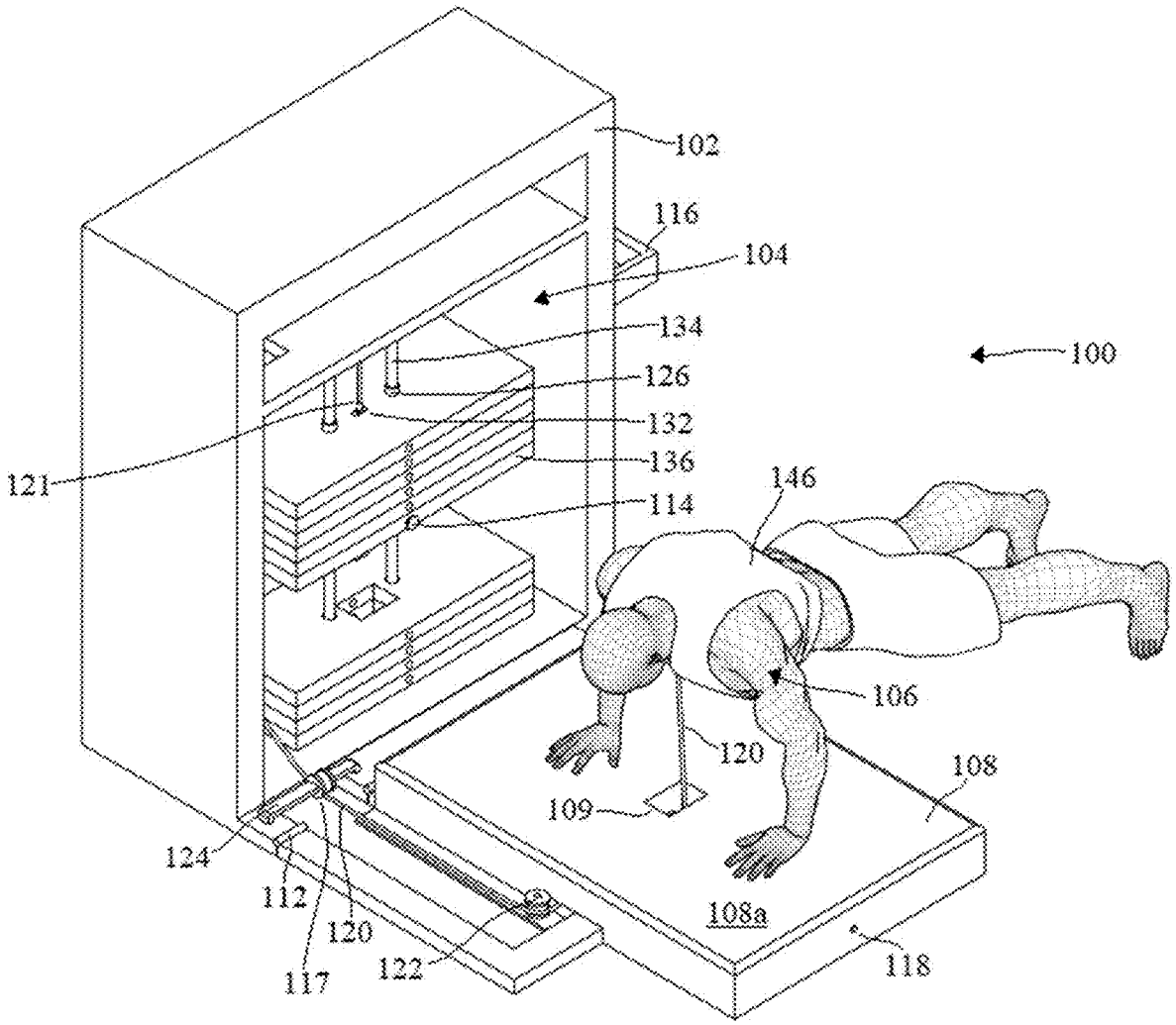
FIG. 2C is a perspective view of an embodiment of the maximum push-up exercise machine showing a user in an uppermost (full extension) position while performing a push-up exercise on the device.

Then, user 106 gets into the starting (prone) position of a push-up exercise with their hands on platform 108 as shown in FIG. 2A. The user is now ready to engage in a push-up exercise with added resistance. As the user raises their body by extending their elbows from platform 108, the user pushes their bodyweight plus the weight they selected from weight stack 136.

User 106 can also place their feet on a step-up exercise platform, swiss ball, medicine ball, or any other object to elevate their feet and change their body's angle. In some embodiments, user 106 can attach the snap link hook to any link of chain 150 to allow for partial range of motion push-up exercises. This allows a user to add more resistance to push-up exercises. User 106 can also attach the snap link hook to any link of the chain to execute timed push-up holds (e.g., planks); isometric push-up. This enables a user to perform both yielding and overcoming isometric push-up exercise with added resistance. Yielding isometric push-up exercise would be a user holding a position few inches before the end position of a push-up for as long as they can even though they can push harder and raise their body. In contrast, overcoming isometric push-up exercise would be a user holding a position few inches before the end position of a push-up and pushing as hard as they can against an immovable resistance.

Figure 3:
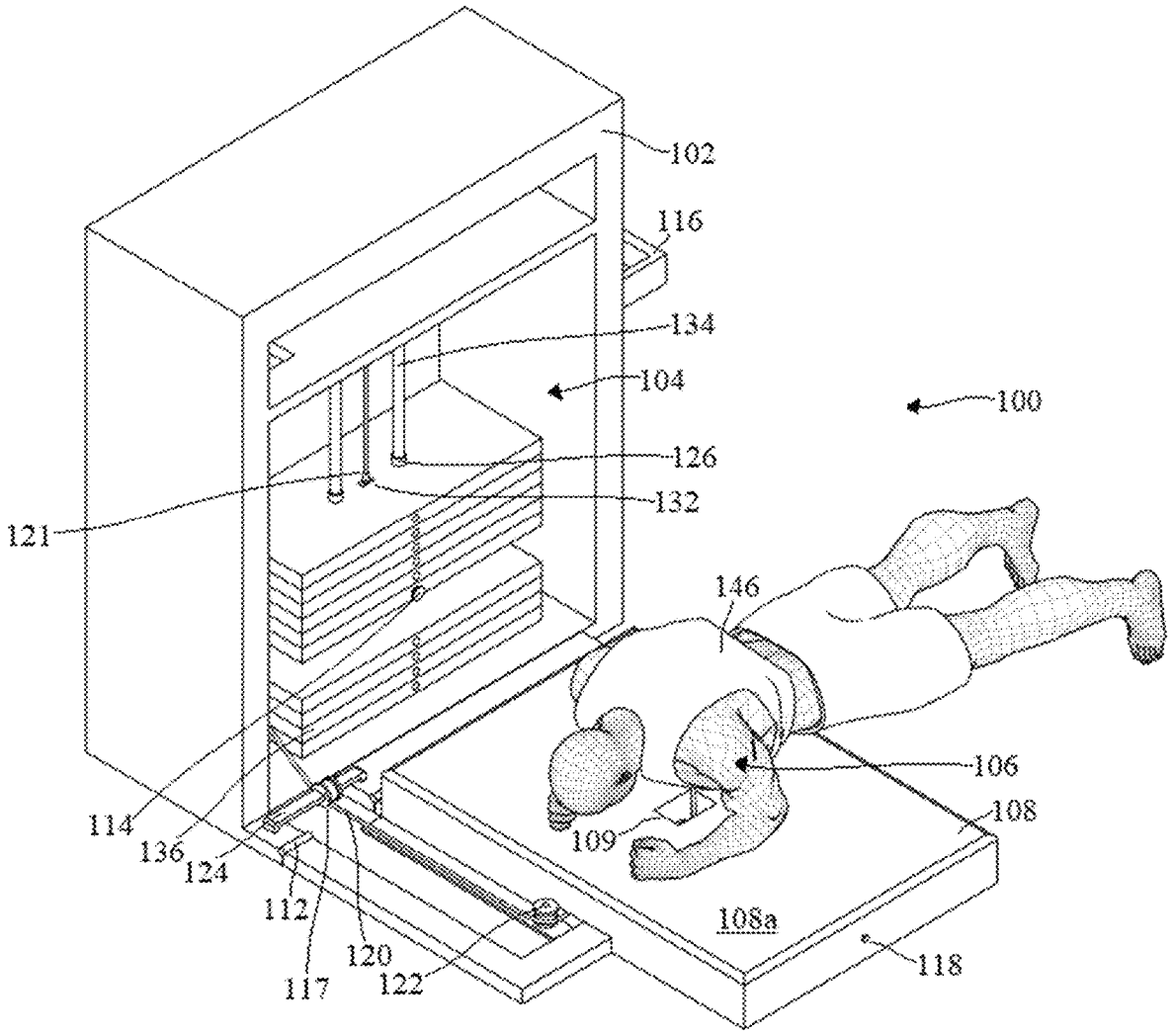
FIG. 3 is a perspective view of an embodiment of the maximum push-up exercise machine showing a user performing a weighted plank exercise on the device.
Figure 4:
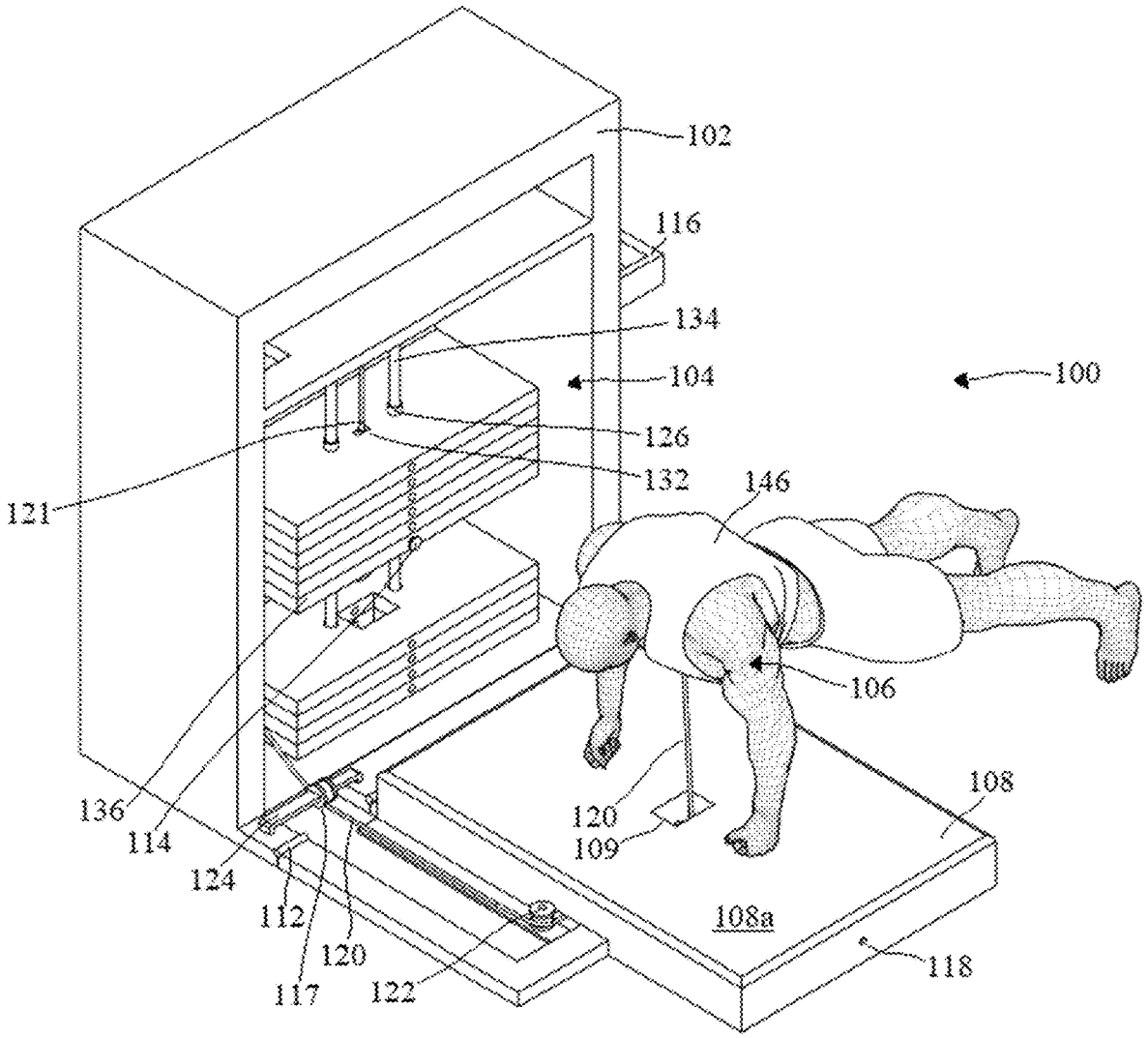
FIG. 4 is a perspective view of an embodiment of the maximum push-up exercise machine showing a user assuming a knuckle (punch/fist) push-up exercise position on the device.
Figure 5:
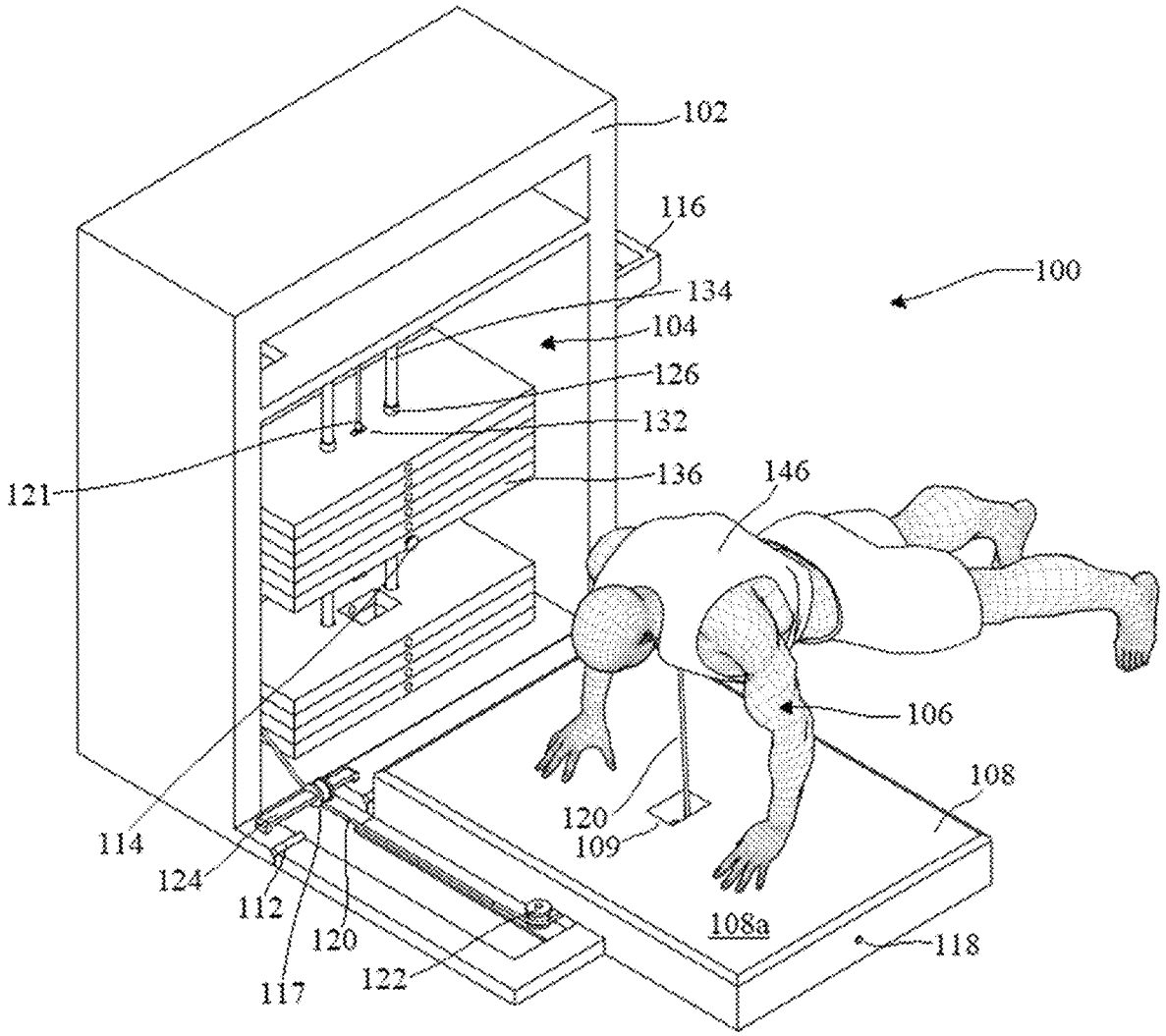
FIG. 5 is a perspective view of an embodiment of the maximum push-up exercise machine showing a user assuming a finger push-up exercise position on the device.

User 106 can perform planks, knuckle (punch/fist) push-up, and finger push-ups with added resistance with the use of a belt or harness as shown in FIGS. 3-5. The user wearing a harness or belt with chain suspended from it can adjust the length of the chain to perform full range of motion, partial range of motion, or isometric knuckle and finger push-ups. This allows the user to progress in their knuckle and finger push-ups. It also allows the user to train their fingers, hands, and wrists in a compound (multi-joint) exercise instead of an isolation (single-joint) exercise saving time and improving all other exercises.

Figure 6A:
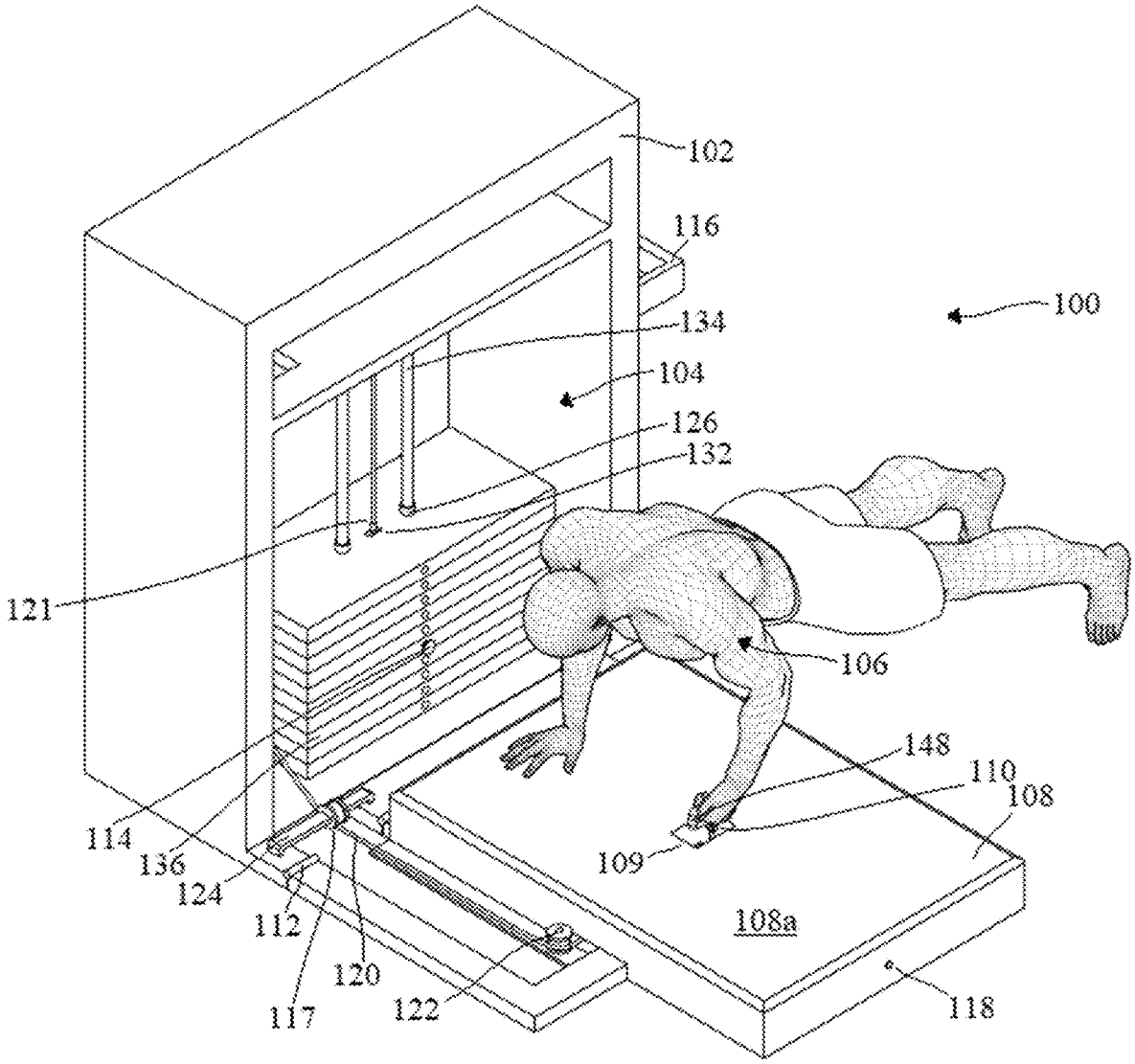
FIG. 6A is a perspective view of an embodiment of the maximum push-up exercise machine showing a user assuming a push-up to row (push-up renegade row) exercise position on the device.
Figure 6B:
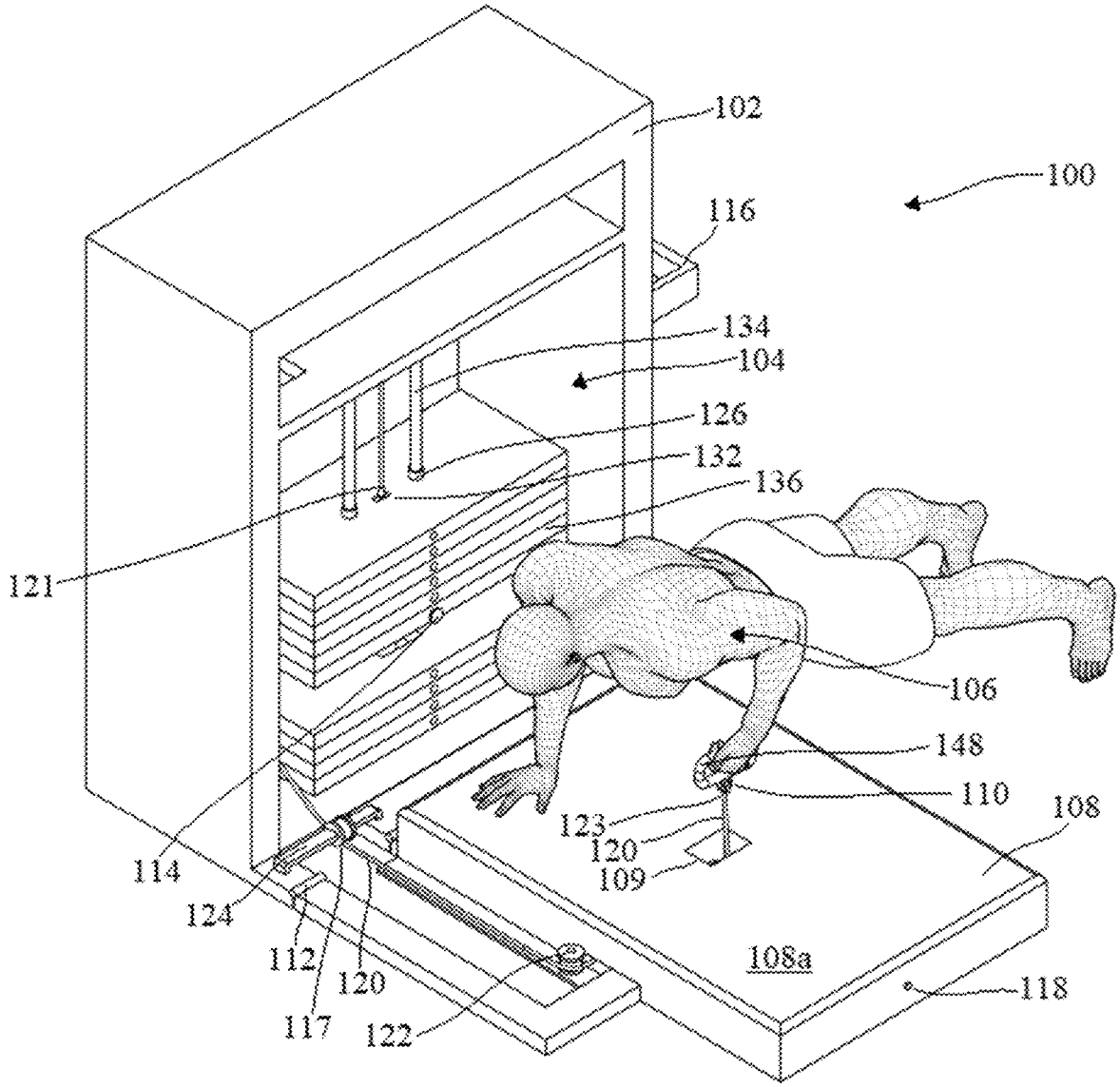
FIG. 6B is a perspective view of an embodiment of the maximum push-up exercise machine showing a user initiating the row movement while performing a push-up to row (push-up renegade row) exercise on the device.

User 106 can perform push-up to row (push-up renegade row) exercise with one hand on platform 108 and other hand using a single cable handle attachment 148 that connects to cable thimble 110 to overcome the weight selected from weight stack 136 of the cable-pulley weight stack system 104 as shown in FIGS. 6A and 6B. In this scenario, the user assumes the end position of a push-up exercise with one arm on the platform and pulls (rows) with the other arm.

Figure 7A:
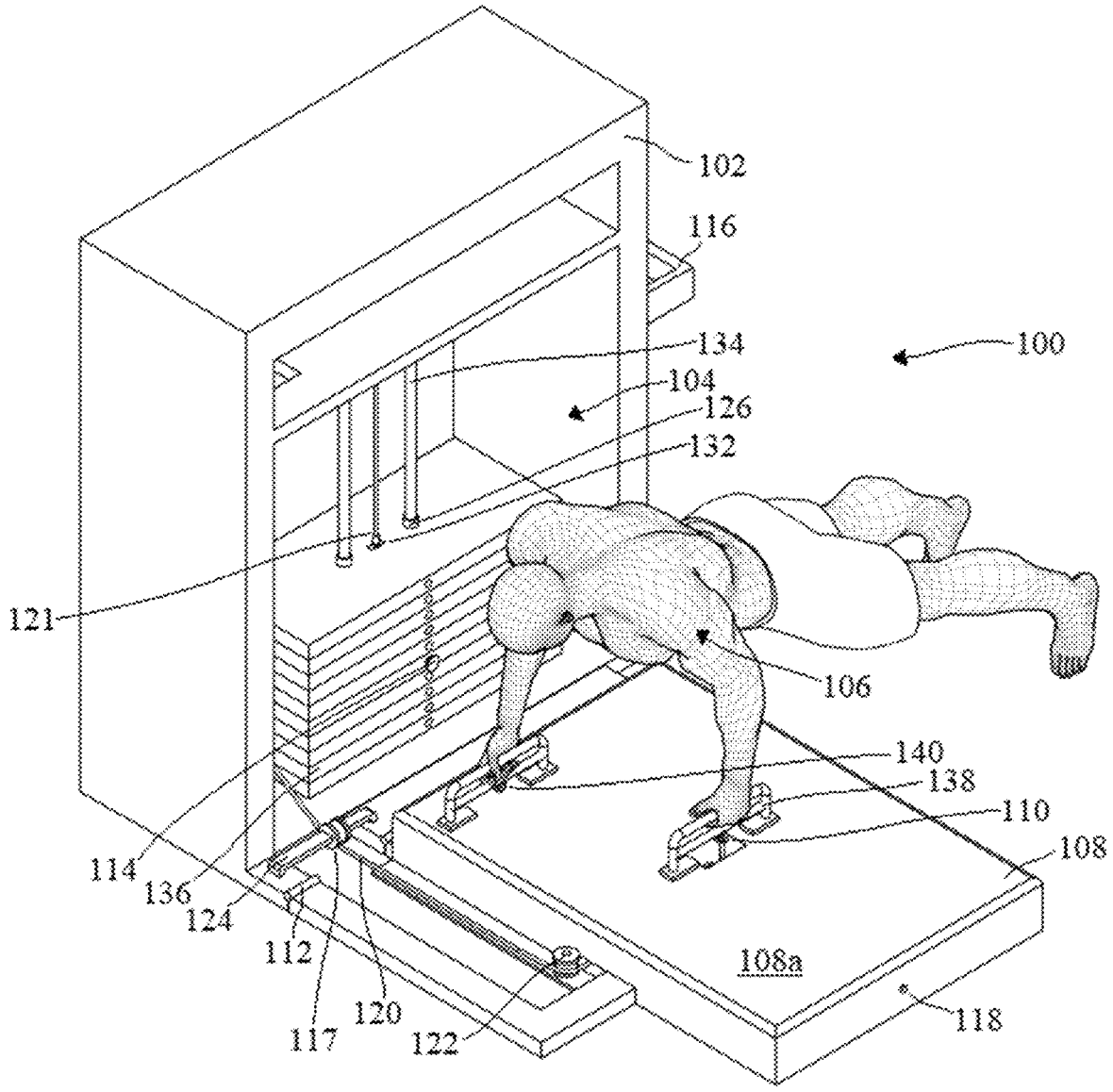
FIG. 7A is a perspective view of an embodiment of the maximum push-up exercise machine showing a user assuming a push-up to row (push-up renegade row) exercise position on the device using push-up bars.
Figure 7B:
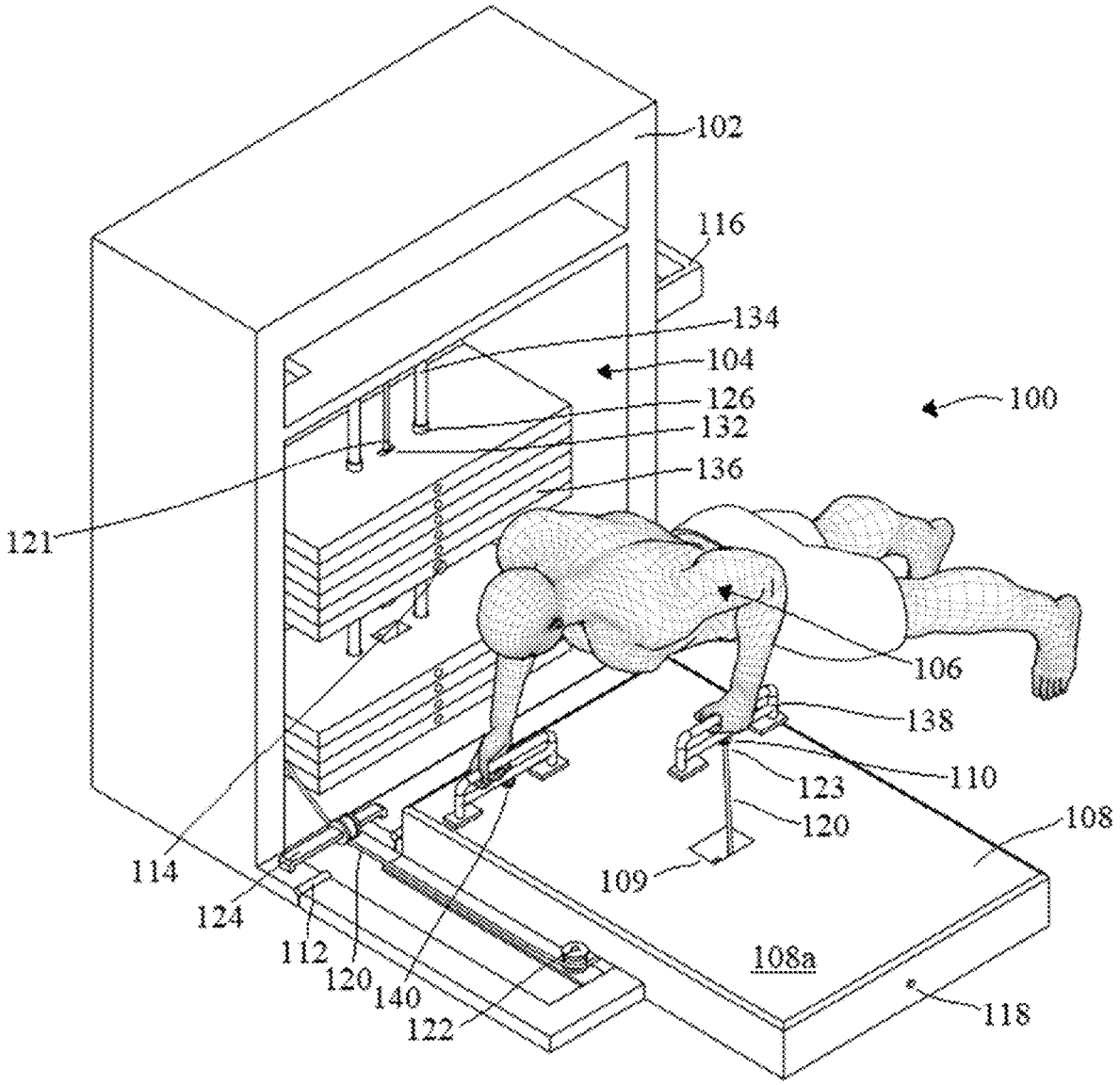
FIG. 7B is a perspective view of an embodiment of the maximum push-up exercise machine showing a user initiating the row movement while performing a push-up to row (push-up renegade row) exercise on the device using push-up bars.

A user 106 can also perform push-up to row exercise using push-up bar 138 with push-up bar cable connector 140 as shown in FIGS. 7A and 7B. In this scenario, the user can perform a full range of motion push-up then pull (row) the weight with one arm. In addition, the user can also perform push-up to row plank hold by using push-up bars of different heights or push-up bar 138 and single cable handle attachment 148 with the pulling arm slightly lower than the other to feel the resistance of the weight and hold that position for as long as they can. This allows the user to engage the core muscles more to resist rotation of the torso because back muscles cannot be relied on as heavily to resist rotation.

Figure 8A:
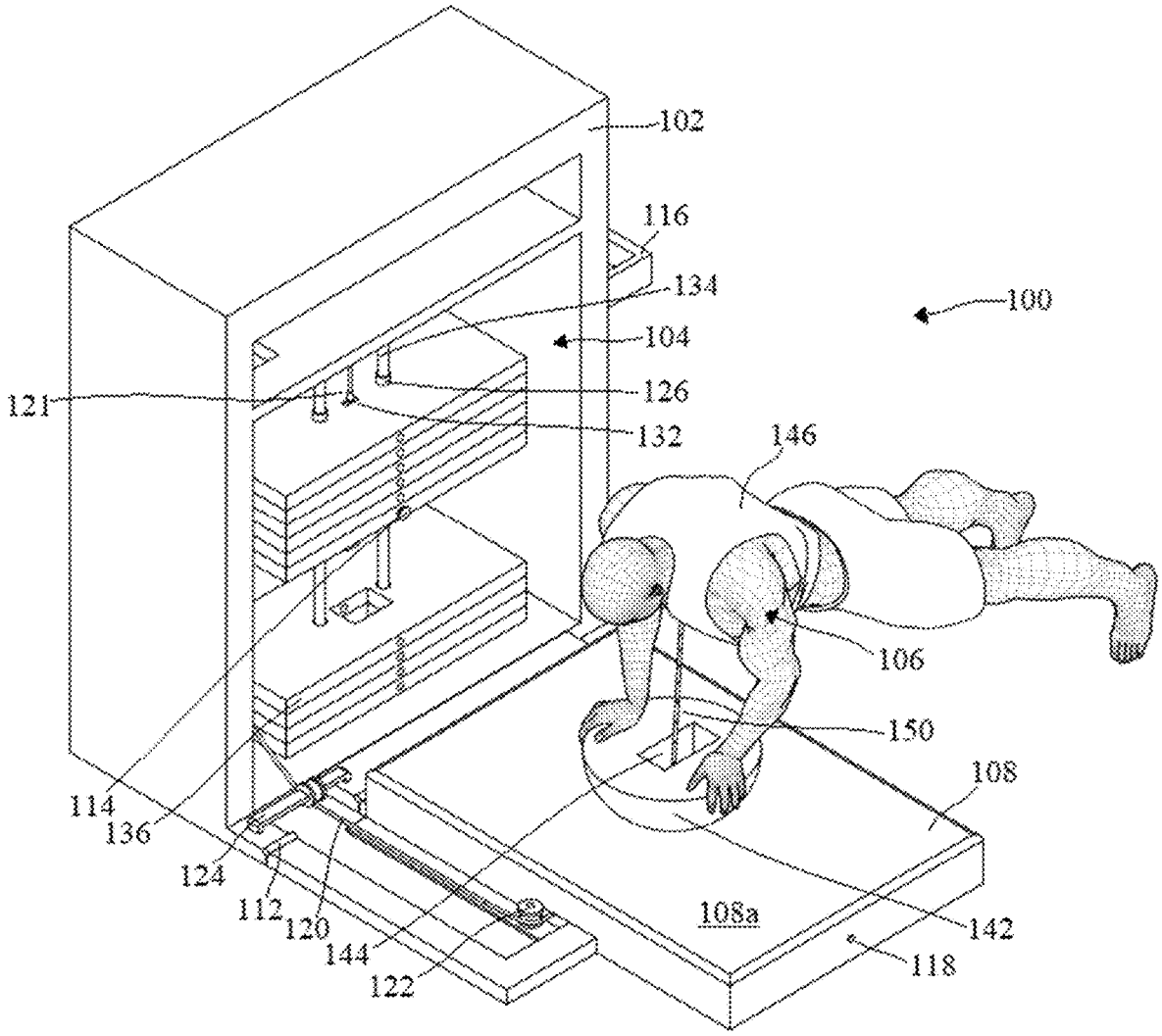
FIG. 8A is a perspective view of an embodiment of the maximum push-up exercise machine showing a user assuming a push-up position on a balance and stabilization ball device.
Figure 8B:
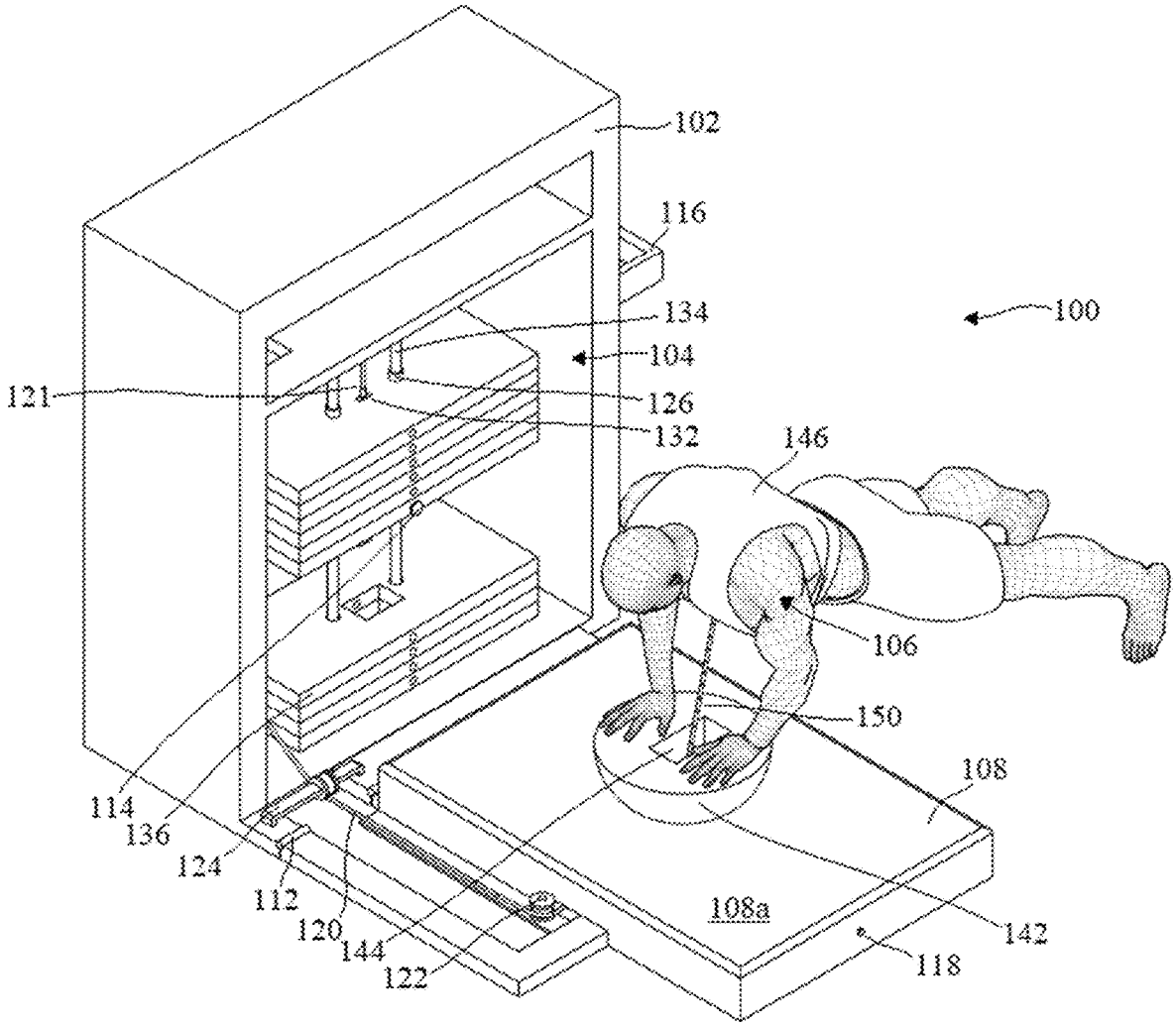
FIG. 8B is a perspective view of an embodiment of the maximum push-up exercise machine showing a user assuming a push-up position on a balance and stabilization ball device.
Figure 8C:
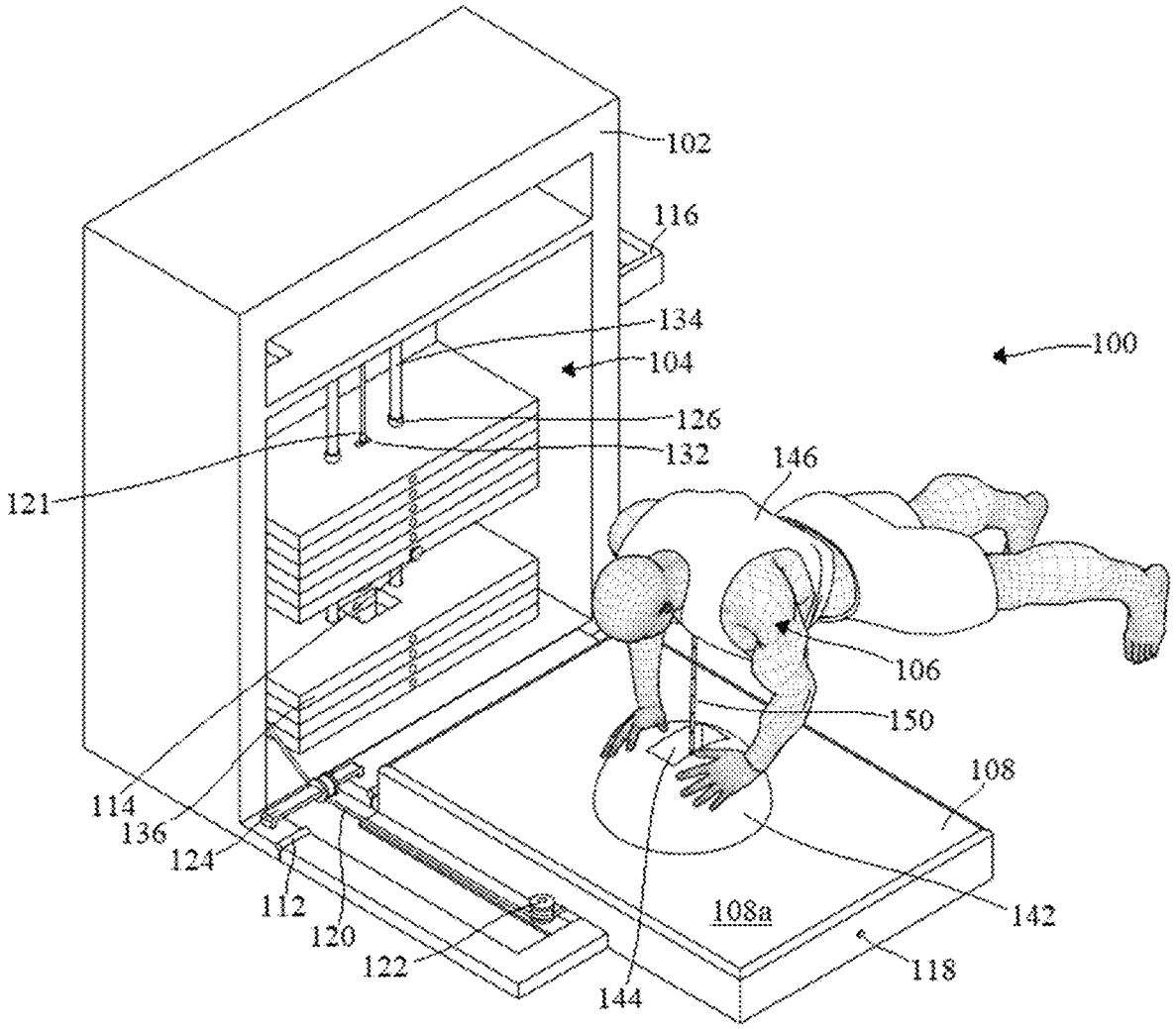
FIG. 8C is a perspective view of an embodiment of the maximum push-up exercise machine showing a user assuming a push-up position on a balance and stabilization ball device.

Another exercise user 106 can perform is push-up exercise with hands on balance and stabilization ball device 142 having a balance and stabilization ball device opening 144 with convex side on platform 108 by wearing harness or belt 146 with chain 150 having snap link hook suspended from harness or belt 146 configured to connect to cable thimble 110 through the balance and stabilization ball device opening 144 to overcome the weight selected from weight stack 136 of cable-pulley weight stack system 104 as shown in FIGS. 8A and 8B. This emphasizes on core development and the user can increase the difficulty of the exercise by adding weight. When the flat side of balance and stabilization ball device 142 having balance and stabilization ball device opening 144 is on platform 108 the user can perform push-up exercise with hands on half ball as shown in FIG. 8C. This emphasizes on inner chest and users can perform this exercise with additional weight to overcome from weight stack 136 of cable-pulley weight stack system 104.

The balance and stabilization ball device may be made of a wooden material with comfort anti-slip grip surface on the flat side of it, high density expanded polypropylene (EPP) foam like foam rollers, or any material known in the art that will withstand a user's weight plus the weight of the weight stack.

| Drawings-Reference Numerals | |
|---|---|
| 100 | maximum push-up exercise machine |
| 102 | cable-pulley weight stack system housing |
| 104 | cable-pulley weight stack system |
| 106 | user |
| 108 | platform |
| 108a | top surface of platform |
| 109 | passage in platform |
| 110 | cable thimble |
| 111 | pulley |
| 112 | hinge |
| 113 | pulley |
| 114 | weight stack selector pin |
| 115 | pulley |
| 116 | container |
| 117 | pulley |
| 118 | rod |
| 119 | exit pulley |
| 120 | cable |
| 121 | first end of cable |
| 122 | pulley |
| 123 | second end of cable |
| 124 | pulley mounts |
| 125 | cable channel |
| 126 | shaft collar |
| 128 | rubber weight stack cushions |
| 130 | weight stack center selector shaft |
| 132 | cable-to-weight stack adapter |
| 134 | weight stack guide rods |
| 136 | weight stack; resistance members |
| 138 | push-up bars |
| 140 | push-up bar cable connector |
| 142 | balance and stabilization ball device; partial spherical balancing device |

-continued

| Drawings-Reference Numerals | |
|---|---|
| 144 | balance and stabilization ball device opening; aperture |
| 146 | harness or belt |
| 148 | single cable handle attachment |
| 150 | chain |

Advantages

From the description above, a number of advantages of the maximum push-up exercise machine become evident:

- The user can perform finger push-ups, knuckle (punch/fist) push-ups, planks, push-ups on balance and stabilization ball device, and push-up to row exercises with added resistance all in one machine.
- The user can progress in the above exercises consistently since it can all be done in one designated space without spending time to set up saving time and great for organization and avoidance of injury.
- The user can eliminate muscular effort from lifting weight plates and placing them in pegs to add or reduce weight with the use of a weight stack system adding intensity to the above exercises.
- The user can train their core muscles and the muscles of their fingers, hands, and wrists heavily in one machine performing compound (multi-joint) exercises instead of isolation (single-joint) exercises.

Accordingly, the maximum push-up machine allows a user to perform push-ups using different hand grips, finger push-ups, and knuckle push-ups through dynamic motion (full range motion and partial range of motion) and static position (yielding isometrics and overcoming isometrics) with added resistance in one machine. Also, the user can quickly change the weight and multiple users can perform push-ups with added resistance together with no muscular effort lost from lifting weight plates and placing them in pegs. In addition, the user can perform push-ups with added resistance using push-up bars and exercise equipment of their choosing. Furthermore, the maximum push-up exercise machine has the additional advantages in that:

- it allows the user to perform push-up to row plank hold exercise which is a unique exercise that works the core muscles heavily while working other muscles as well as saving the user's time to spend on isolation exercises to target core muscles.
- it allows the user to train their core muscles and the muscles of their hands, fingers, and wrists more often and consistently along with other muscle groups without spending time performing isolation (single-joint) exercises, performing workouts for core and lower arm muscles, and affecting one's recovery because of time spent performing core and lower arm workouts from major workouts and/or sports.
- it allows the user to perform numerous exercises in one machine that are beneficial to people of all ages.
- it provides a user a complete workout when paired with pulling exercises, shoulder presses, and lower body exercises.

The above described embodiment is not intended to limit the scope of the present invention, as one skilled in the art can, in view of the present invention, expand such embodiment to correspond with the subject matter of the present invention claimed below. Therefore, all such substitutions and modifications are intended to be embraced within the scope of the invention as defined in the appended claims.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. An exercise device for performing resisted push-up exercises, comprising:

a housing containing a plurality of resistance members;

a cable in operable communication with one or more of the plurality of resistance members, such that forcible movement of the cable imparts a force onto the one or more resistance members in operable communication with the cable;

a first attachment component in operable communication with the cable;

a horizontal platform having a top surface, a bottom surface, and a passage extending through the top surface towards the bottom surface, the passage sized to house the attachment component in operable communication with the cable when the exercise device is not in use by a user;

the first attachment component further including a position of repose when not subject to an external force applied by the user, wherein the position of repose includes the first attachment component residing below the top surface of the platform and being unable to exit the cable passage without the external force overcoming a resistance force of the one or more resistance members in operable communication with the cable;

whereby the position of repose of the first attachment component residing below the top surface allows the user to reach a full push-up flexion position with the user's chest on the top surface of the platform while the first attachment component remains subject to the resistance force of the one or more resistance members.

2. The exercise device of claim 1, further including at least one pulley to guide the cable from the housing to the passage in the platform.

3. The exercise device of claim 2, wherein the at least one pulley includes an exit pulley located adjacent to the passage in the platform below the top surface, the exit pulley configured to guide the cable from a horizontal orientation prior to the passage in the platform to a vertical orientation at the passage, thereby allowing the user to pull the cable vertically while executing a push-up.

4. The exercise device of claim 1, wherein the resistance members are weights adapted to move within the housing when subject to an external force.

5. The exercise device of claim 1, wherein the passage in the platform is located at a position in the platform in which there are no permanent structures preventing a user from performing push-ups with the user's hands on the top surface of the platform and chest is in overlying relation to the passage.

6. The exercise device of claim 1, wherein the first attachment component is a cable thimble.

7. The exercise device of claim 1, further including an upper body harness having a second attachment component configured to mechanically engage the first attachment component.

8. The exercise device of claim 7, further including:

the passage sized to receive both the first and second attachment components;

whereby the passage can receive the first and second attachment components below the top surface of the platform when the user reaches a full push-up flexion position with the user's chest adjacent to the top surface of the platform.

9. The exercise device of claim 1, further including a balancing device having at least a partial spherical shape and a generally centrally located aperture in a curved outer surface sized to receive at least a portion of the cable.

10. The exercise device of claim 1, further including a hinge residing between the platform and the housing containing the plurality of resistance members, thereby enabling the platform to fold upward into a vertical orientation.

11. The exercise device of claim 1, further including a push-up bar having a second attachment component configured to mechanically engage the first attachment component.

12. An exercise device for performing resisted push-up exercises, comprising:

a housing containing a plurality of resistance members;

a cable in operable communication with one or more of the plurality of resistance members, such that forcible movement of the cable imparts a force onto the one or more resistance members in operable communication with the cable;

a first attachment component in operable communication with the cable;

a second attachment component configured to engage the first attachment component and a user-interactable device;

a horizontal platform having a top surface, a bottom surface, and a passage extending through the top surface towards the bottom surface, the passage sized to receive both the first and second attachment components;

whereby the passage can receive the first and second attachment components below the top surface of the platform when the user reaches a full push-up flexion position with the user's chest adjacent to the top surface of the platform.

13. The exercise device of claim 12, further including a pulley located adjacent to the passage in the platform and below the top surface of the platform, the pulley configured to guide the cable from a horizontal orientation prior to the passage in the platform to a vertical orientation at the passage, thereby allowing the user to pull the cable vertically while executing a push-up.

14. The exercise device of claim 12, wherein the resistance members are weights adapted to move within the housing when subject to an external force.

15. The exercise device of claim 12, wherein the passage in the platform is located at a position in the platform in which there are no permanent structures preventing a user from performing push-ups with the user's hands on the top surface of the platform and chest is in overlying relation to the passage.

16. The exercise device of claim 12, wherein the user-interactable device is a push-bar.

17. The exercise device of claim 12, wherein the user-interactable device is an upper body harness.

18. The exercise device of claim 12, further includes a partial spherical balancing device having a generally centrally located through hole sized to receive the cable, wherein the partial spherical balancing device can reside in overlying relation to the passage in the platform to create an unstable surface.

19. The exercise device of claim 12, further including a hinge residing between the platform and the housing containing the plurality of resistance members, thereby enabling the platform to fold upward into a vertical orientation.

20. An exercise device for performing resisted push-up exercises, comprising:

a housing containing a weight stack, wherein in the weight stack includes a plurality of weights adapted to move within the housing when subject to an external force;

a cable having a first end and a second end, the first end in operable communication with one or more weights in the weight stack, such that tension imparted on the cable acts as the external force to move the plurality of weights;

a first attachment component in operable communication with the second end of the cable;

an upper body harness having a second attachment component configured to mechanically engage the first attachment component;

a horizontal platform having a top surface, a bottom surface, and a passage extending through the top surface towards the bottom surface, the passage sized to receive both the first and second attachment components;

the cable extending from the housing to the passage and passing underneath the top surface of the platform;

an exit pulley located adjacent to the passage in the platform, the exit pulley residing below the top surface of the platform and oriented to direct the cable through the passage;

the passage sized to receive the first and second attachment components below the top surface of the platform when the user reaches a full push-up flexion position with the user's chest adjacent to the top surface of the platform; and the second end of the cable and the first and second attachment components configured to exit the passage through the top surface of the platform when the user is wearing the harness and reaches a full push-up extension position.

* * * * *